US007152669B2

(12) United States Patent
Kroetsch et al.

(10) Patent No.: US 7,152,669 B2
(45) Date of Patent: Dec. 26, 2006

(54) END CAP WITH AN INTEGRAL FLOW DIVERTER

(75) Inventors: Karl Paul Kroetsch, Williamsville, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 412 days.

(21) Appl. No.: 10/696,324

(22) Filed: Oct. 29, 2003

(65) Prior Publication Data

US 2005/0109492 A1 May 26, 2005

(51) Int. Cl.
*F28F 9/22* (2006.01)

(52) U.S. Cl. ..... 165/149; 165/174; 165/175

(58) Field of Classification Search ..... 165/149, 165/173–175

See application file for complete search history.

(56) References Cited

U.S. PATENT DOCUMENTS

| | | | | | |
|---|---|---|---|---|---|
| 4,287,945 | A | * | 9/1981 | Hessari | 165/167 |
| 4,557,324 | A | * | 12/1985 | Kondo et al. | 165/174 |
| 4,775,006 | A | * | 10/1988 | Hesse | 165/150 |
| 5,186,249 | A | | 2/1993 | Bhatti et al. | 165/174 |
| 5,465,783 | A | | 11/1995 | O'Connor | 165/134.1 |
| 5,481,800 | A | * | 1/1996 | Hutto et al. | 29/890.043 |
| 5,806,586 | A | * | 9/1998 | Osthues et al. | 165/174 |
| 6,056,047 | A | * | 5/2000 | Gowan | 165/174 |
| 6,116,335 | A | * | 9/2000 | Beamer et al. | 165/174 |
| 6,543,528 | B1 | * | 4/2003 | Saito et al. | 165/153 |
| 6,575,227 | B1 | * | 6/2003 | Leeson et al. | 165/44 |
| 6,729,386 | B1 | * | 5/2004 | Sather | 165/110 |
| 6,973,805 | B1 | * | 12/2005 | Higashiyama | 62/525 |
| 2002/0162643 | A1 | * | 11/2002 | Leeson et al. | 165/41 |
| 2003/0098141 | A1 | * | 5/2003 | Fernstrum | 165/44 |
| 2004/0069468 | A1 | * | 4/2004 | Lamich et al. | 165/148 |
| 2005/0092461 | A1 | * | 5/2005 | Kroetsch et al. | 165/67 |

FOREIGN PATENT DOCUMENTS

| | | | |
|---|---|---|---|
| GB | 434907 | * | 9/1935 |
| JP | 06159983 A | * | 6/1994 |
| SU | 355472 | * | 11/1972 |

* cited by examiner

*Primary Examiner*—Allen J. Flanigan
(74) *Attorney, Agent, or Firm*—Patrick M. Griffin

(57) ABSTRACT

An end cap closes the open end of the tank. The end cap is comprised of an inlet diverter wall and tube diverter wall. The inlet diverter wall extends into the tank across the inlet axis for redirecting fluid from the inlet and longitudinally into the tank along the end of the core. The tube diverter wall also extends longitudinally into the tank in a spaced relationship to the tubes of the core for directing fluid out of the tubes and longitudinally into the tank. A first embodiment of the invention provides tube diverter walls that are planar. A second embodiment of the invention provides tube diverter walls that are curved.

18 Claims, 4 Drawing Sheets

END CAP WITH AN INTEGRAL FLOW DIVERTER

BACKGROUND OF THE INVENTION

1. Field of the Invention

The subject invention relates to automotive heat exchangers and more particularly to the tank of an automotive radiator with a flow diverter.

2. Description of the Related Art

Various flow diverters are well known in the prior art which allow coolant to be directed into the tank of a heat exchanger. Examples of such a flow diverters are disclosed in the U.S. Pat. No. 5,186,249 (the '249 patent) to Bhatti et al. and the U.S. Pat. No. 5,465,783 (the '783 patent) to O'Connor.

The '249 patent discloses a heat exchanger that comprises a core, a plurality of inlet and outlet flow tubes, an inlet and return tank, and a plurality of baffles. The baffles are located within the inlet and return tank for providing uniform coolant flow through the inlet and outlet flow tubes. An inlet baffle is positioned angularly within the inlet tank with respect to the flow axis for directing coolant into the inlet tank. The surface of the inlet baffle is perforated to allow some coolant to pass directly through to the tubes directly behind. A return baffle is connected to the outer wall of the return tank such that its surface is positioned parallel to the flow axis of the tubes. The return baffle is positioned to slow the low temperature coolant that has entered the return tank from the inlet tubes. This provides more uniform coolant flow through the outlet flow tubes which results in better thermal performance while reducing erosion in the outlet flow tubes.

The '783 patent discloses several embodiments of a sacrificial erosion bridge for a heat exchanger having an inlet pipe, an inlet tank and a core comprised of flow tubes. As the coolant enters the inlet tank from the inlet pipe, the coolant strikes the sacrificial erosion bridge which in turn deflects the coolant away from the ends of the flow tubes and into the inlet tank. This reduces the erosion of the ends of the flow tubes. In a first embodiment, the sacrificial erosion bridge is brazed to the inlet tank such that it is in the direct path of the coolant flow. This directs the coolant in two directions along the length of the inlet tank. In a second embodiment, the sacrificial erosion bridge has a flow diverter rib. This flow diverter rib runs parallel to the row of flow tubes. When coolant enters the inlet tank from the inlet tube, the rib divides the coolant into two paths away from the flow tubes and into the inlet tank. In a third embodiment, the sacrificial erosion bridge is formed to be integral to the inlet pipe. The sacrificial erosion bridge is formed as an inlet cup on the end of the inlet pipe. The inlet cup extends beyond the inlet pipe and has a closed end. There are a number of holes, formed around the circumference of the inlet cup, that allow coolant to enter the inlet tank without directly contacting the inlet pipes. A fourth embodiment discloses an inlet cup that, instead of having holes and a closed end, has an end that forms an angled flap to direct coolant into the inlet tank an away from the flow tubes.

In all of these embodiments, the flow diverter is an independent component requiring manufacture and fabrication into the tank.

BRIEF SUMMARY OF THE INVENTION AND ADVANTAGES

The subject invention provides a sacrificial erosion device integrated within the end cap of the inlet tank to direct the coolant away from the tank walls and into the tank.

A heat exchanger comprises a core that includes fins and tubes extending between opposite ends. A tank has a longitudinal axis and extends across one end of the core and is in fluid communication with the tubes. The tank has an open end and defines an inlet on an inlet axis adjacent the open end and transverse to the longitudinal axis. An end cap closes the open end and presents an inlet diverter wall extending into the tank across the inlet axis for re-directing fluid from the inlet and longitudinally into the tank and along the one end of the core.

The vast majority of the automotive heat exchanger market is dominated by heat exchangers comprising an aluminum core and a plastic tank. The all aluminum type of heat exchanger is favorable because of the packaging advantages that result from a smaller tank width that can be incorporated from the elimination of the tank to header crimp area. However, this narrow tank width creates concerns from a flow erosion perspective. Aluminum materials are sensitive to coolant impingement. Therefore, the erosion resulting from the entrance of the coolant into the inlet tank must be avoided to insure an extended useful service life.

To solve this problem, a flow diverter integrated within the end cap of the inlet tank. This flow diverter is placed in the direct path of the coolant flow such that it directs the coolant into the tank and away from the tank walls. One of the advantages of incorporating the flow diverter into the end cap is that it eliminates the secondary process of welding a flow diverter onto the tank walls thus reducing the overall number of parts needed for assembly.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
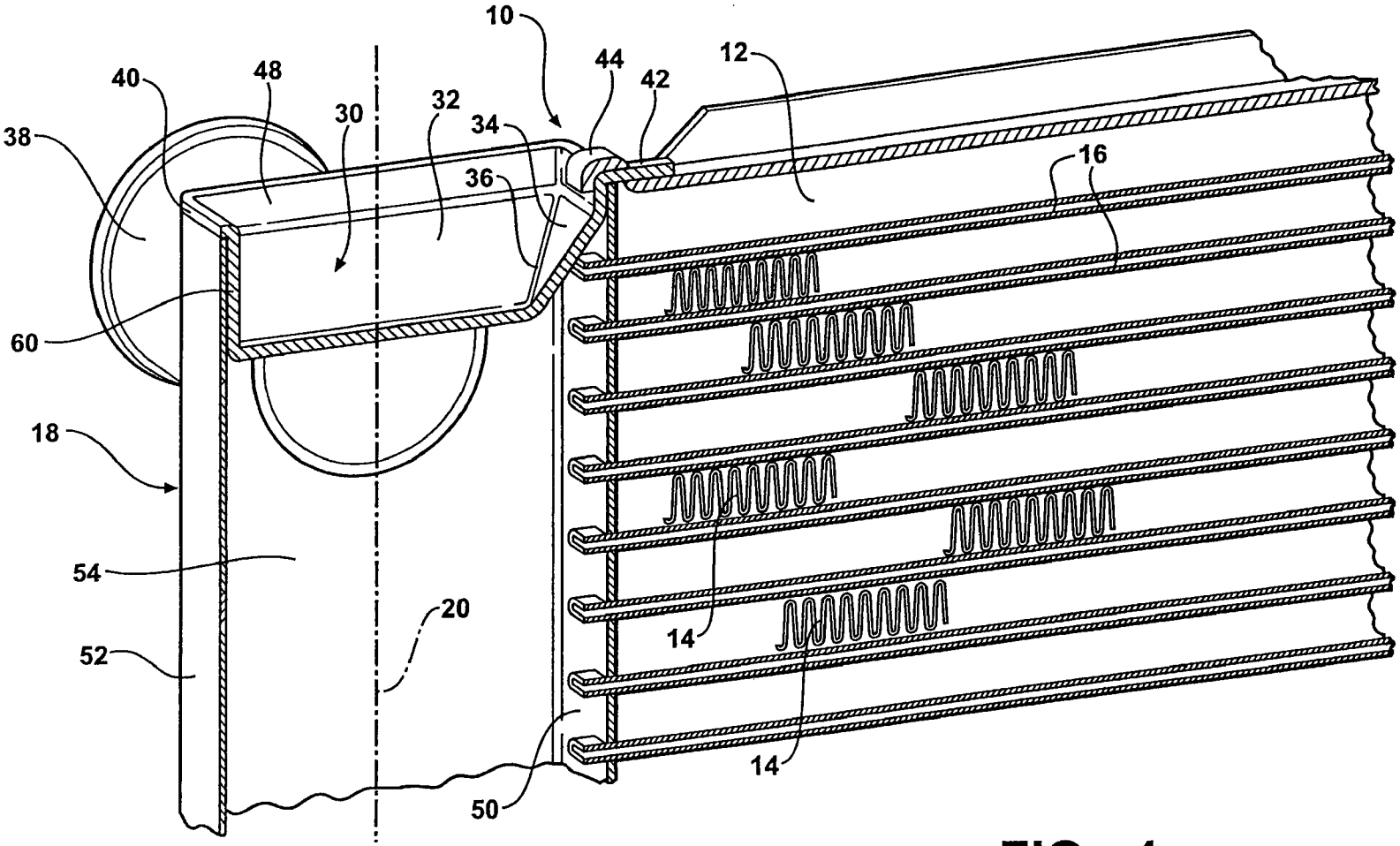
FIG. 1 is a perspective view, partially broken away and in cross-section, of a heat exchanger.

Referring to the Figures, wherein like numerals indicate like or corresponding parts throughout the several views, an aluminum heat exchanger 10, such as a radiator, is generally shown at 10 in FIG. 1.

The heat exchanger 10 includes fins 14 and tubes 16 extending between opposite ends of a core 12. Additionally, a tank 18 with a longitudinal axis 20 extends across one end of the core 12 and is in fluid communication with the tubes 16.

Figure 2:
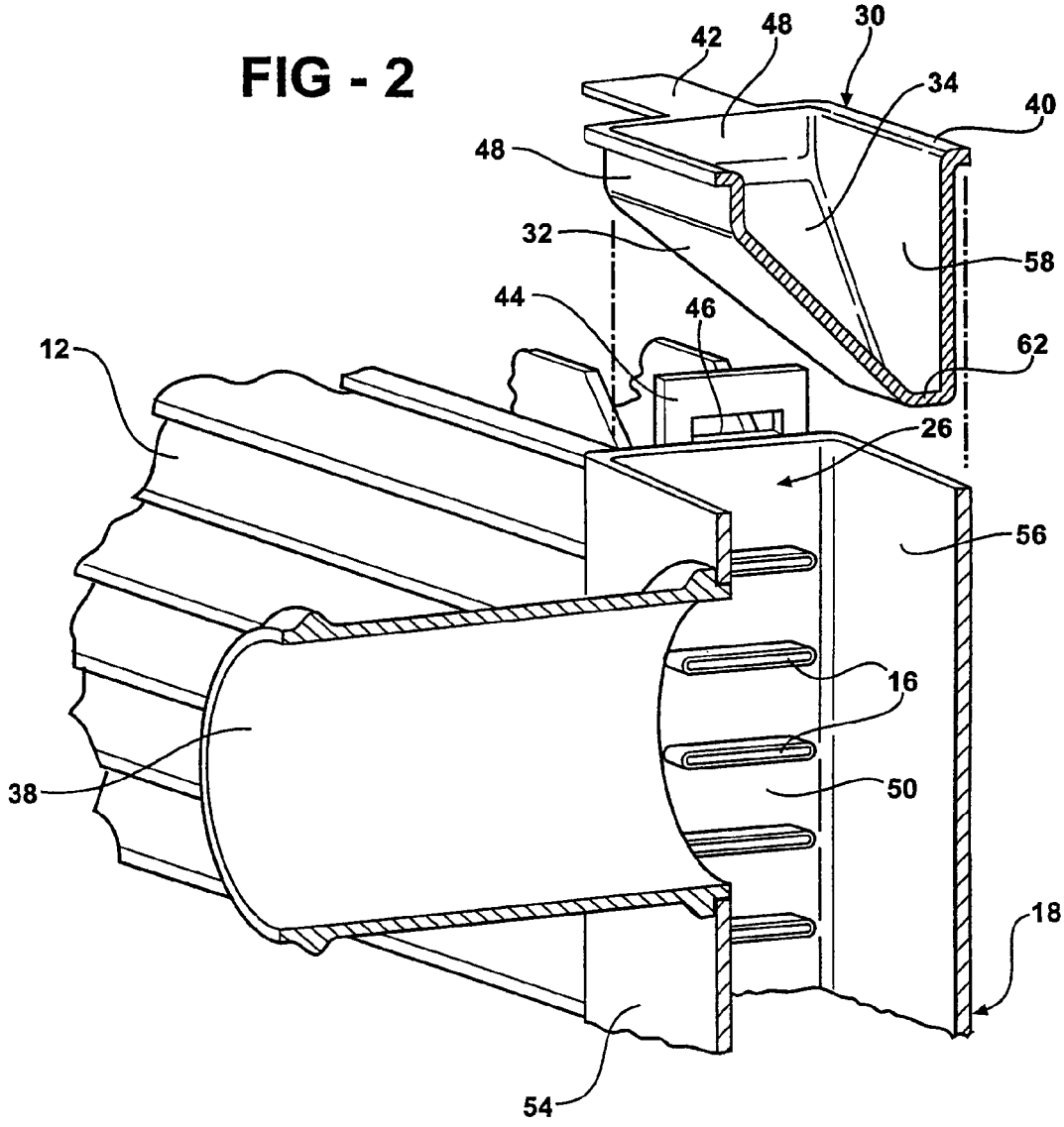
FIG. 2 is an exploded perspective view, partially broken away and in cross-section, of the heat exchanger and end.

The tank 18 is rectangular in cross section with an open end 26 and a tube wall 50 surrounding the tubes 16, shown in more detail in FIG. 2. First 54 and second 56 side walls are parallel and extend between the tube wall 50 and an outer wall 52. An inlet 38 is disposed in the first wall 54 on an inlet axis 28 adjacent the open end 26 and extends transverse to the longitudinal axis 20 of the tank 18.

Figure 3:
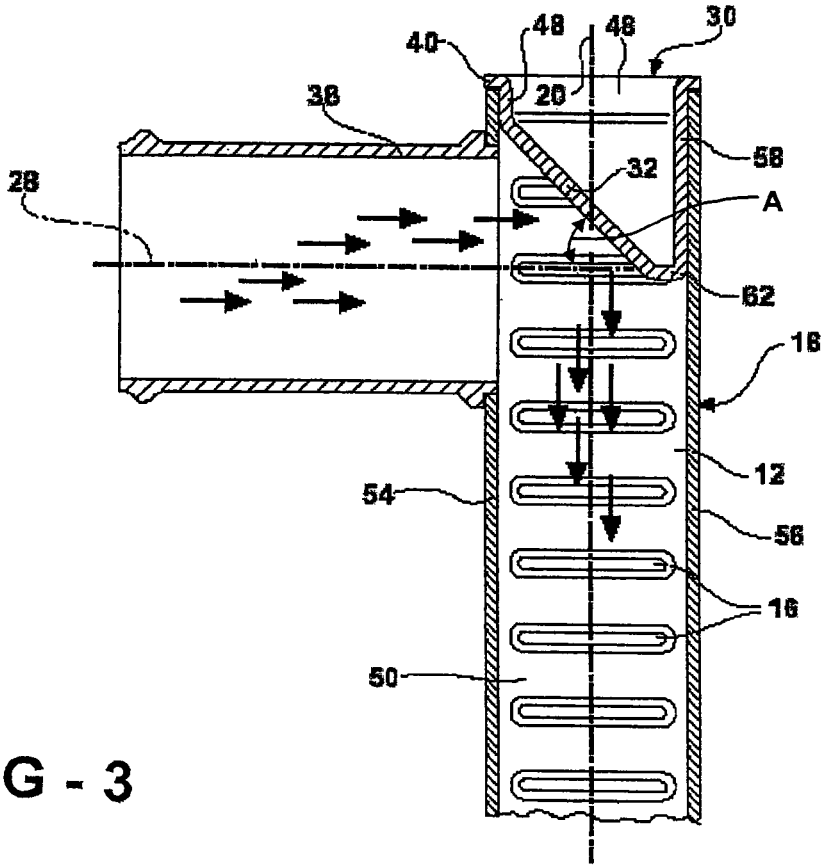
FIG. 3 cap is a partial cross-sectional view of the tank assembly.
Figure 4:
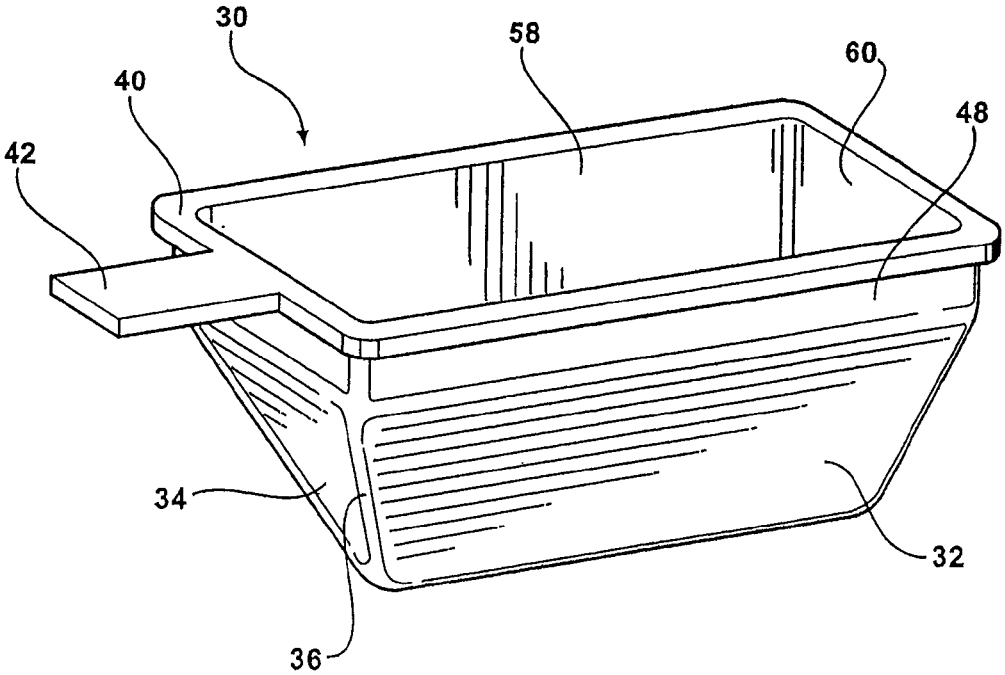
FIG. 4 is a perspective view of the end cap.

An end cap, generally shown at 30, closes the open end 26 of the tank 18 and includes a peripheral flange 40 that extends over and engages the open end 26 of the tank 18, as shown in FIGS. 2 and 3. A peripheral waist 48 depends from the peripheral flange 40 and engages the interior of the tank 18. An inlet diverter wall 32, tube diverter wall 34, face 58 and rear wall 60 depend from the peripheral waist 48. The inlet diverter wall 32 extends into the tank 18 across the inlet axis 28 for redirecting fluid from the inlet 38 and longitudinally into the tank 18 along the end of the core 12. The tube diverter wall 34 also extends longitudinally into the tank 18 in a spaced relationship to the tubes 16 of the core 12 for directing fluid out of the tubes 16 and longitudinally into the tank 18. The tube diverter wall 34 adjoins the inlet diverter wall 32 to define a corner 36 therebetween.

The inlet 32 and tube diverter walls 34 are planar and slant away from the first side wall 54 and tube wall 50 respectively creating an acute angle A with said inlet axis 28. Accordingly, the inlet diverter wall 32, tube diverter wall 34, and corner 36 extend into the tank 18 in a pyramidal fashion. The diverter walls 32, 34 and face and rear walls 60 converge at a linear peak 62 that extends along a peak from the corner 36 to the rear wall 60.

The face wall 58 extends straight from the peripheral waist 48 and engages the second 56 of the side walls 54, 56 of the tank 18. Similarly, the rear wall 60 extends straight from the peripheral waist 48 and engages the outer wall 52 of the tank 18.

A core reinforcement extension 44 extends from the core 12 parallel to the longitudinal axis 20 and defines an access slot 46. The end cap 30 includes a locking tab 42 that extends through the access slot 46 when the end cap 30 is inserted in the open end 26 of the tank 18. To initially secure the end cap 30 into the open end 26 of the tank 18, the core reinforcement extension 44 is bent over the locking tab 42. Similarly, the end of the core reinforcement extension 44 is bent over the peripheral waist 48 adjacent the locking tab 42, temporarily securing the assembly. To permanently secure the end cap 30 into the open end 26 of the tank 18, the end cap 30 is brazed to the tank 18.

Figure 5:
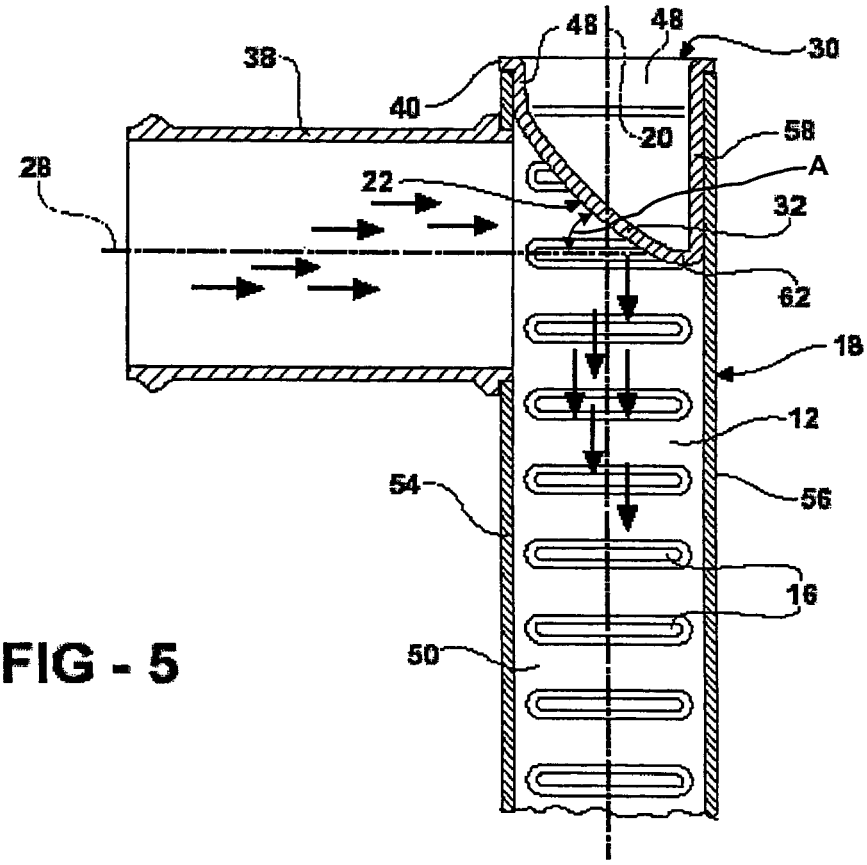
FIG. 5 is a view like FIG. 2, but showing a second embodiment of the invention.
Figure 6:
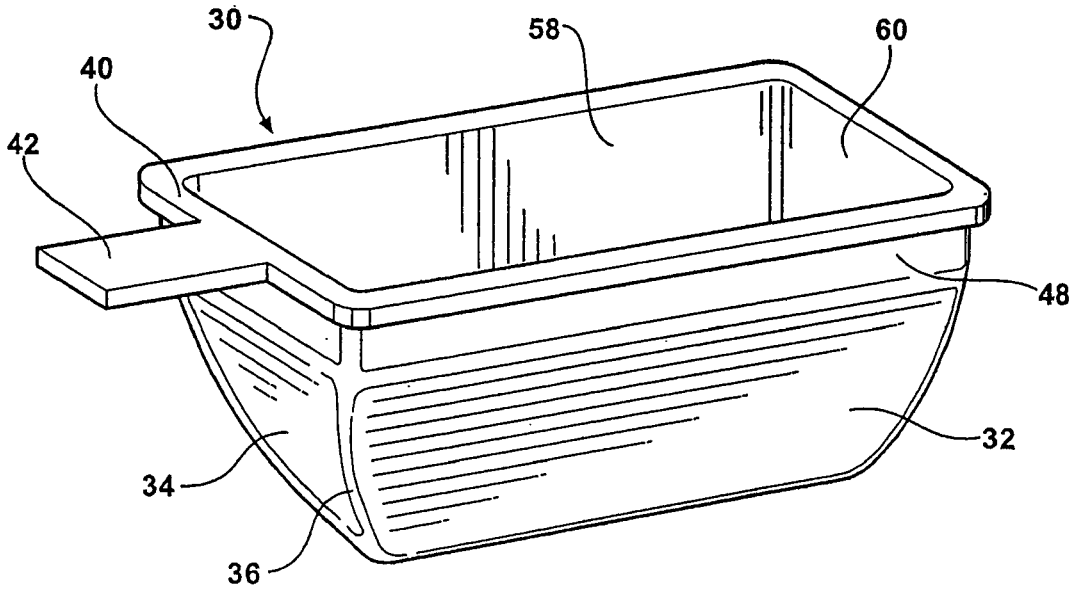
FIG. 6 is a perspective view of the end cap of the second embodiment of the invention.

An alternate embodiment of the invention is shown generally in FIG. 5. The inlet 32 and tube diverter walls 34 are curved and slanted away from the first side wall 54 and tube wall 50 respectively, as show in FIG. 6. Accordingly, the inlet diverter wall 32 presents a convex surface 22 that curves across and faces the inlet axis 28 at an acute angle A. This could also be a concave surface or a combination thereof.

What is claimed is:

1. A heat exchanger comprising:

a core including fins and tubes extending between opposite ends;

a tank having a longitudinal axis and extending across one end of said core and in fluid communication with said tubes;

said tank having an open end and defining an inlet on an inlet axis adjacent said open end and transverse to said longitudinal axis; and an end cap closing said open end and presenting an inlet diverter wall extending into said tank and intersecting said inlet axis at an acute angle, said inlet diverter wall being disposed to intercept fluid flowing into the tank through the inlet along the inlet axis and to re-direct the fluid into said tank in the direction of the longitudinal axis.

2. A heat exchanger in claim 1 wherein said inlet diverter wall is planar.

3. A heat exchanger in claim 1 wherein said inlet diverter wall is curved.

4. A heat exchanger in claim 3 wherein said inlet diverter wall presents one of a convex and concave surface facing said inlet and curving across said inlet axis at an acute angle A.

5. A heat exchanger in claim 1 wherein said end cap further comprises a tube diverter wall extending longitudinally into said tank in spaced relationship to said tubes of said core and adjoining said inlet diverter wall to define a corner therebetween to direct fluid out of said tubes and longitudinally into said tank.

6. A heat exchanger in claim 5 wherein said tube diverter wall is planar.

7. A heat exchanger in claim 6 wherein said tube diverter wall slants away from said tube wall.

8. A heat exchanger in claim 7 wherein said corner extends into said tank in a pyramidal fashion.

9. A heat exchanger in claim 5 wherein said tube diverter wall is curved.

10. A heat exchanger in claim 5 including a core reinforcement extension extending from said core parallel to said longitudinal axis and defining an access slot, said end cap including a locking tab extending through said access slot.

11. A heat exchanger in claim 10 wherein said core reinforcement extension is bent over said locking tab.

12. A heat exchanger in claim 1 wherein said end cap is secured to said tank by brazing.

13. A heat exchanger in claim 1 wherein said tank and said end cap are aluminum.

14. A heat exchanger in claim 5 wherein said end cap includes a peripheral flange extending over and engaging said open end of said tank.

15. A heat exchanger in claim 14 wherein said end cap includes a peripheral waist depending from said flange and engaging the interior of said tank.

16. A heat exchanger in claim 15 wherein said diverter walls extend inwardly from said waist in a pyramidal fashion.

17. A heat exchanger in claim 16 wherein said tank is rectangular in cross section with a tube wall surrounding said tubes and an outer wall and two parallel side walls extending between said tube and outer walls, said inlet being disposed in a first of said side walls, said end cap including a face wall extending straight from said waist and engaging the second of said side walls of said tank, said cap including a rear wall extending straight from said waist and engaging said outer wall of said tank.

18. A heat exchanger in claim 17 wherein said diverter walls and said face and rear walls of said end cap converge at a linear peak extending from said corner to said rear wall.

* * * * *